United States Patent [19]

Shimomura et al.

[11] Patent Number: 4,856,475

[45] Date of Patent: Aug. 15, 1989

[54] ROTATIONAL FREQUENCY CONTROL APPARATUS OF INTERNAL COMBUSTION ENGINE

[75] Inventors: Setsuhiro Shimomura; Yukinobu Nishimura, both of Hyogo, Japan

[73] Assignee: Mitsubishi Denki Kabushiki Kaisha, Tokyo, Japan

[21] Appl. No.: 145,215

[22] Filed: Jan. 19, 1988

[30] Foreign Application Priority Data

Jan. 20, 1987 [JP] Japan ..... 62-10773
Feb. 2, 1987 [JP] Japan ..... 62-22683

[51] Int. Cl.[4] ..... F02D 41/16
[52] U.S. Cl. ..... 123/339
[58] Field of Search ..... 123/339, 585

[56] References Cited

U.S. PATENT DOCUMENTS

| | | | |
|---|---|---|---|
| 4,425,886 | 1/1984 | Kuroiwa et al. | 123/339 |
| 4,563,989 | 1/1986 | Peter | 123/339 |
| 4,567,869 | 2/1986 | Peter et al. | 123/339 |
| 4,658,783 | 4/1987 | Janetzke et al. | 123/339 |
| 4,672,934 | 6/1987 | Peter et al. | 123/339 |
| 4,709,674 | 12/1987 | Bianchi et al. | 123/339 |
| 4,716,871 | 1/1988 | Sakamoto et al. | 123/339 |
| 4,742,807 | 5/1988 | Sakamoto et al. | 123/339 |

*Primary Examiner*—Tony M. Argenbright
*Attorney, Agent, or Firm*—Bernard, Rothwell & Brown

[57] ABSTRACT

A rotational frequency control apparatus of an internal combustion engine comprising a bypass route bypassing a throttle valve provided to an intake pipe of internal combustion engine, an intake control valve which controls an intake amount of this bypass route, an intake drive and control device which drives and controls open and close conditions of this intake control valve, and moreover, an intake amount sensor which detects the intake amount of the intake pipe, a rotational frequency sensor which detects a rotational frequency of the engine, a rotational frequency adjusting part which generates a target intake amount based on an actual rotational frequency detected by the rotational frequency sensor and a target rotational frequency, an intake amount adjusting part which outputs an intake control signal based on the target intake amount and the actual intake amount detected by the intake amount sensor, a switching part which causes both adjusting parts to make output operations under an unloaded condition of the engine and switches an operation mode to a stop mode while the engine transfers to a loaded operating condition, and a memory means which stores the target intake amount outputted from the rotational frequency adjusting part and the intake control signal outputted from the intake amount adjusting part under the unloaded operating condition and also holds and outputs, in the loaded operating condition, a final target intake amount and final intake control signals under the unloaded operating condition.

12 Claims, 5 Drawing Sheets

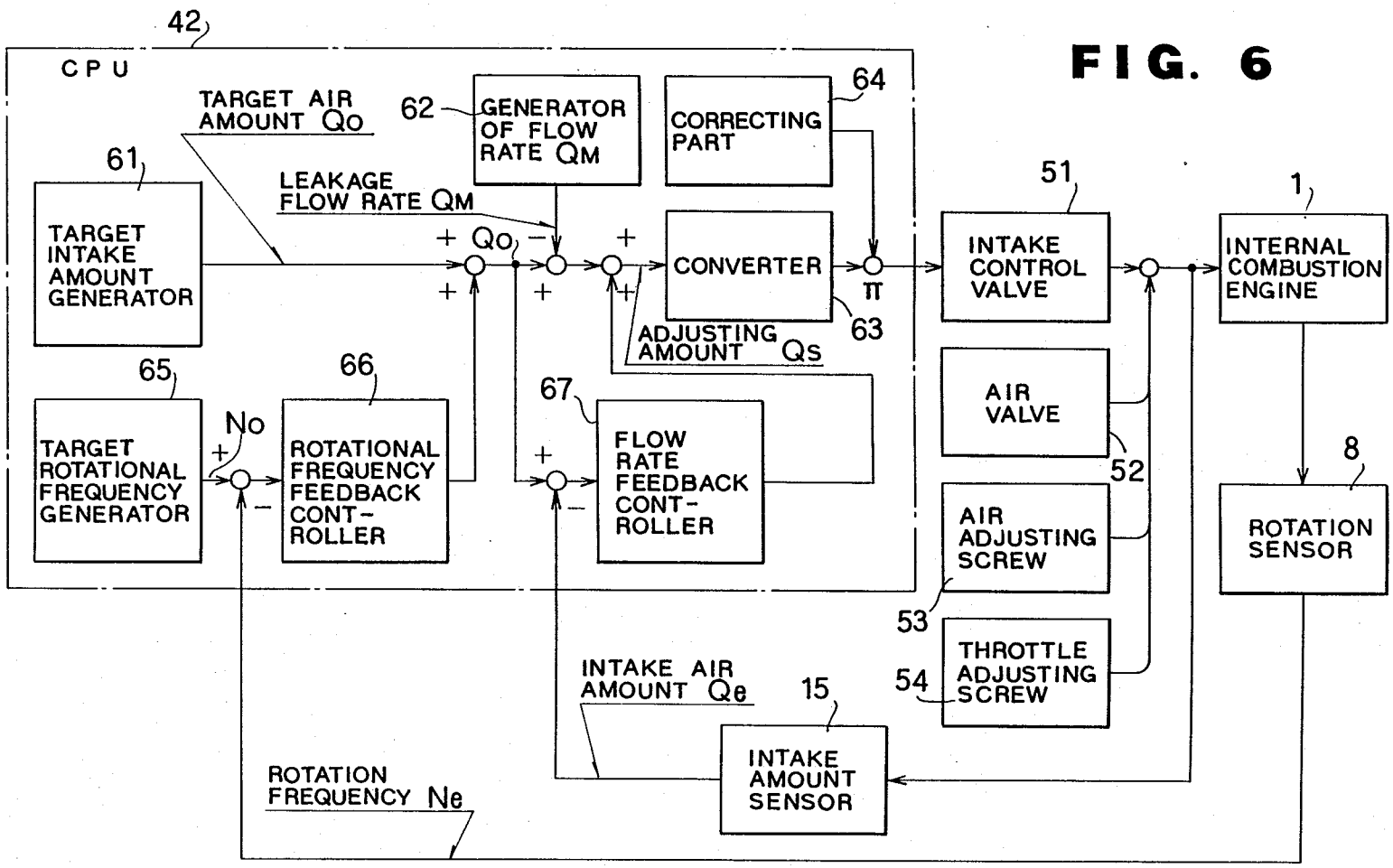
FIG. 6
INTERNAL COMBUSTION ENGINE
1
ROTATION SENSOR
8
INTAKE CONTROL VALVE
51
AIR VALVE
52
AIR ADJUSTING SCREW
53
THROTTLE ADJUSTING SCREW
54
INTAKE AMOUNT SENSOR
15
INTAKE AIR AMOUNT Qe
CORRECTING PART
64
CONVERTER
63
TT
ADJUSTING AMOUNT Qs
FLOW RATE FEEDBACK CONT-ROLLER
67
GENERATOR OF FLOW RATE QM
62
LEAKAGE FLOW RATE QM
Qo
ROTATIONAL FREQUENCY FEEDBACK CONT-ROLLER
66
ROTATION FREQUENCY Ne
No
TARGET AIR AMOUNT Qo
42
CPU
TARGET INTAKE AMOUNT GENERATOR
61
TARGET ROTATIONAL FREQUENCY GENERATOR
65

ROTATIONAL FREQUENCY CONTROL APPARATUS OF INTERNAL COMBUSTION ENGINE

BACKGROUND OF THE INVENTION

1. Field of the Invention

The present invention relates to a rotational frequency control apparatus of an internal combustion engine wherein the intake adjustment and rotational frequency adjustment operations are realized in higher speed through utilization of a loop for adjusting the intake amount to a target value and a loop for adjusting a rotational frequency to a target value.

2. Description of the Prior Art

Unloaded rotational frequency of an internal combustion engine has been controlled to a predetermined constant rotational frequency. Objects of such rotational frequency are to set unloaded rotational frequency to a lower value in order to suppress, as much as possible, fuel consumption under the unloaded condition and to suppress variation of rotational frequency due to disturbances. Therefore, the rotational frequency control is always required to have quick and highly accurate controllability. Factors causing varying rotational frequency are roughly divided into a primary factor due to variation of unloaded loss of the engine itself and variation of thermal efficiency of engine and a secondary factor due to variation of adjustment gain internally existing in an intake amount adjusting means used for adjusting variation of rotational frequency by the primary factor and variation of density of atmospheric air considered as the intake source.

Therefore, as proposed in Japanese Laid-open Patent No. 162340 1984, there is prior art in which a rotational frequency is controlled to the target value by controlling an intake amount adjusting means in accordance with an adjusting signal based on deviation between the target value of rotational frequency and actual value and an adjusting signal based on deviation between the target intake amount or intake pipe pressure and actual value.

According to the prior art described above the following advantage can be attained. Namely, since the adjusting signal (rotational frequency adjusting signal) based on deviation between the target value of rotational frequency and actual value responds to the primary factor of rotational variation while the adjusting signal (intake adjusting signal) based on deviation between the target value of intake amount or intake pipe pressure and an actual value responds to the secondary factor, a rotational variation can be adjusted more quickly and accurately than in the case of feedback control based only with the rotational frequency.

As explained heretofore, the prior art described above proposes employing an intake amount adjusting loop in order to self-correct an error of a rotational frequency control means itself.

However, the rotational frequency control apparatus of the internal combustion engine of the prior art mentioned above also provides following disadvantages.

First, under the unloaded condition, a rotational frequency is controlled to the target value but when the engine is set to the loaded condition after the throttle valve opens a little, if an adjustment is enabled, the primary factor and secondary factor are no longer adjusted, an intake amount of the engine changes suddenly, increase or decrease of the rotational frequency becomes abnormal, remarkably deteriorating operationability.

Particularly for the secondary factor, the aging due to initial fluctuation of control means or clogging becomes large and it becomes a problem not to be neglected.

Moreover, as explained previously, the rotational frequency control means is provided with an intake amount adjusting loop in order to correct an error thereof by itself in addition to a rotation frequency adjusting loop in the conventional apparatus mentioned above. In case the engine rotates, for example, at the rotational frequency determined by a target rotational frequency generating circuit corresponding to the engine temperature, such conventional apparatus has also been accompanied by such a defect that eventually its response characteristic cannot exceed the response characteristic of the apparatus provided with only the rotational frequency adjusting loop, since the difference between the target rotational frequency and actual rotational frequency of the engine is corrected by a rotational frequency operation unit.

SUMMARY OF THE INVENTION

In order to eliminate various problems explained previously, it is therefore a first object of the present invention to provide a rotational frequency control apparatus which can prevent the uncontinuous sudden change of intake amount of engine and generation of abnormal increase or decrease of rotational frequency even in case adjustment of primary factor and secondary factor while the engine is changed to the loaded condition from the unloaded condition is disabled and thereby remarkably increases operational performance of the internal combustion engine.

It is a second object of the present invention to provide a rotational frequency control apparatus which copes with generation of variation in rotational frequency by the secondary factor resulting from variation of intake density due to an initial fluctuation of adjusting gain of intake amount control means and clogging of the intake filter particularly in the initial engine start condition and always stabilizes a rotational frequency of the internal combustion engine by eliminating the discrepancy based on such secondary factor, even under the initial engine start condition where a variation of adjusting gain which easily generates such secondary factor occurs and even after the use for a considerable period where clogging of the filter may occur.

It is a third object of the present invention to provide a rotational frequency control apparatus which assures a high response characteristic to a decrease of a rotational frequency of an engine by assuring an optimum amount of air through an output of intake amount by compensation stored in the memory for difference between the target rotational frequency and actual rotational frequency in case an error of the rotational frequency control means itself results for example, from an error of intake amount due to the engine temperature.

In order to attain such objects, the rotational frequency control apparatus of internal combustion engine of the present invention comprises a means which operates a rotational frequency controller and an intake controller of engine under the unloaded condition and then stops operations of these controllers under the loaded condition and a memory which maintains, even under the loaded condition, the rotational frequency adjusting signal and intake amount adjusting signal stored under the unloaded condition of engine and applies such signals for suppressing sudden change of rotational frequency when the engine transfers to the loaded condition from the unloaded condition.

Moreover, for example, in order to eliminate a bad response characteristic of rotational frequency control based on control error resulting from the engine temperature, a memory means, which previously stores the amount of air which the engine intakes while the throttle is perfectly closed in addition to an adjusted intake amount provided by an intake amount adjusting means, is provided particularly as required; and thereby an amount based on the stored air amount subtracted from the target air amount is supplied for the engine by the intake amount adjusting means.

BRIEF DESCRIPTION OF THE DRAWINGS

FIG. 6 is a functional block diagram for explaining operation of the rotational frequency control apparatus of the second embodiment illustrated in FIG. 3.

DETAILED DESCRIPTION OF THE PREFERRED EMBODIMENTS

The preferred embodiments of the rotational frequency control apparatus of the internal combustion engine of the present invention will be explained in detail by referring to the accompanying drawings.

Figure 1:
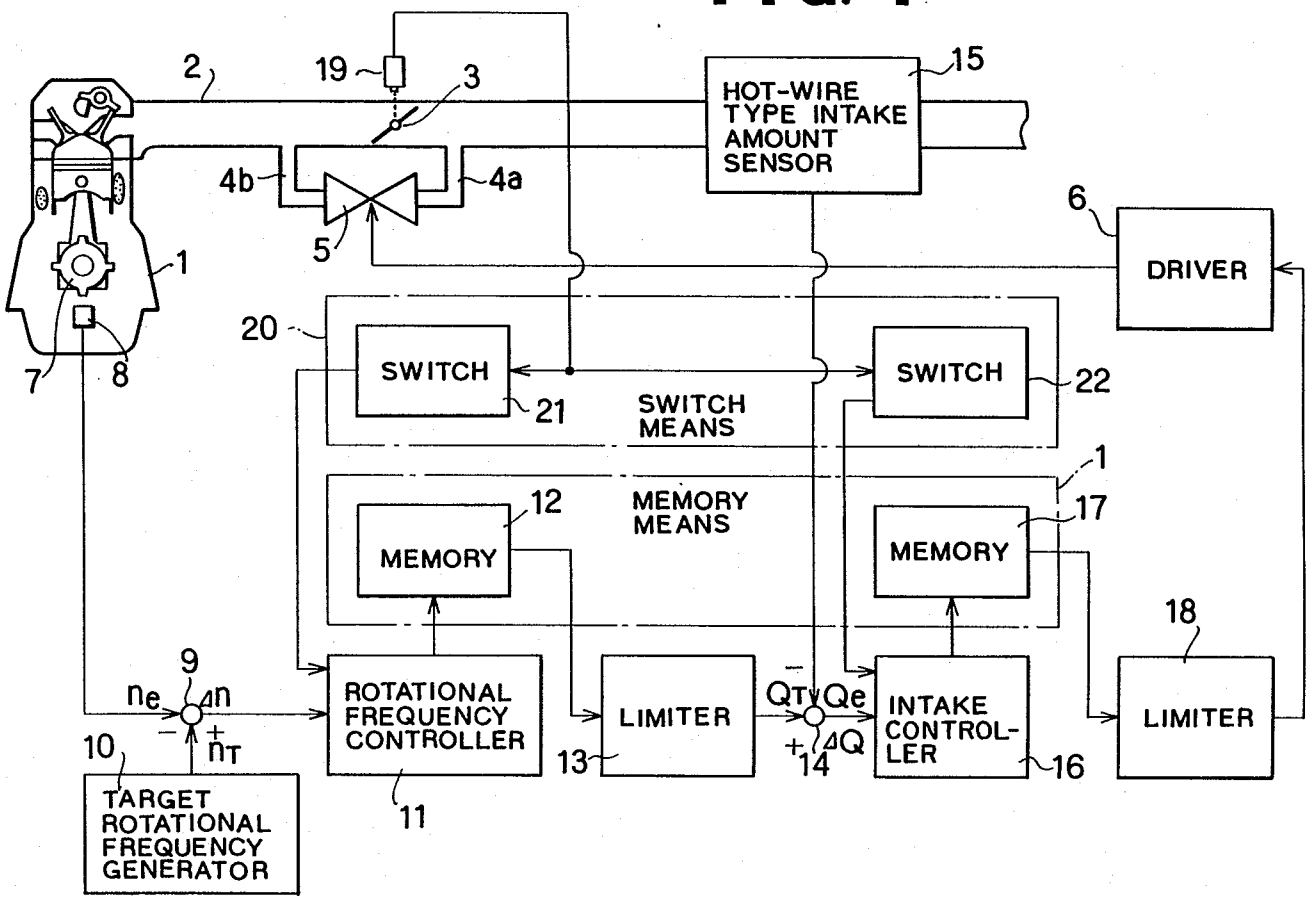
FIG. 1 is a block diagram of a rotational frequency control apparatus of an internal combustion engine illustrating the first embodiment of the present invention.

FIG. 1 is a block diagram of a rotational frequency control apparatus of an internal combustion engine showing the first embodiment of the present invention. In this figure, an internal combustion engine 1 is connected with an intake pipe 2 and the specified area is provided with a throttle valve 3. The throttle valve 3 controls rotational frequency in accordance with a load. Bypass routes **4*a*, 4*b* are connected to the intake pipe 2 before and after this throttle valve 3**.

Moreover, a solenoid valve 5 having a linear characteristic is provided between these bypass routes **4*a* and 4*b* as an intake control valve. This solenoid valve 5 is controlled and driven by an output of a driver 6**.

Meanwhile, an output shaft of the internal combustion engine 1 is provided with a gear 7. This gear 7 operates in conjunction with rotation of the internal combustion engine 1. The rotation of this gear 7 is sensed by a rotational frequency sensor 8. The rotational frequency sensor 8 detects rotation of gear 7 and outputs a rotational frequency of engine $n_e$ to an error amplifier 9.

An output $n_T$ of a target rotational frequency generator 10 is also input to the error amplifier 9, which obtains an error $\Delta n$ between an output $n_e$ of the rotational frequency sensor 8 and an output $n_T$ of the target rotational frequency generator 10 and outputs it to a rotational frequency controller 11.

The target rotational frequency generator 10 generates a target value of rotational frequency under the unloaded condition corresponding to various conditions such as an engine temperature and the rotational frequency controller 11 receives an output of the error amplifier 9 and generates a rotational frequency adjusting signal in such a direction as to eliminate the error $\Delta n$ by proportional, integral or differential operation.

An output of this rotational frequency controller 11 is sent to a limiter 13 through a memory 12. This limiter 13 limits an output of the rotational frequency controller 11 to a value lower than a predetermined value.

An output of the limiter 13 becomes a target intake amount $Q_T$ of the engine. This target intake amount $Q_T$ is sent to an error amplifier 14, to which an intake amount $Q_e$ is also input from a hot-wire type intake amount sensor 15.

The hot-wire type intake amount sensor 15 is provided to the intake pipe 2 and has a good response characteristic. The intake amount $Q_e$ outputted from the hot-wire type intake amount sensor 15 and the target intake amount $Q_T$ outputted from the limiter 13 are sent to the error amplifier 14 in order to obtain an error $\Delta Q$ which is then outputted to an intake controller 16.

This intake controller 16 receives the error $\Delta Q$ and generates an intake adjusting signal in such a direction as to eliminate the error $\Delta Q$ by proportional, integral or differential operation and sends its output to a limiter 18 via a memory 17.

This limiter 18 adjusts the output of the intake controller 16 to a specified value or less. The output of this limiter 18 is sent to the driver 6, which sends a drive signal to the solenoid valve 5, to increase or decrease the opening area.

In addition, the throttle valve 3 operates in conjunction with a non-load switch 19. An output of this non-load switch 19 controls a switch means 20 consisting of a first switch 21 and a second switch 22 and outputs of these first and second switches 21 and 22 control the rotational frequency controller 11 and the intake controller 16, respectively.

Next, operations of rotational frequency control apparatus of the internal combustion engine of the present invention constituted as explained previously are explained hereunder. When the unloaded condition of engine is detected by the non-load switch 19, the switches 21, 22 control the rotational frequency controller 11 and intake controller 16, respectively, to the operating condition.

Meanwhile, as the gear 7 rotates in conjunction with rotation of the internal combustion engine, rotation of the gear 7 is detected by the rotation sensor 8 and a rotational frequency $n_e$ is output to the error amplifier 9, in which an error $\Delta n$ to the output $n_T$ of the target rotational frequency generator 10, namely the rotational frequency error $\Delta n$ is calculated. The rotational frequency controller 11 operates with the rotational frequency error $\Delta n$ and generates an output.

This rotational frequency controller 11 generates the target intake amount of the internal combustion engine 1 in relation to a rotational frequency of the engine 1 and the target rotational frequency, and an output of this rotational frequency controller 11 is generated in such a direction as to reduce the error $\Delta n$ output from the error amplifier 9. Therefore, when the rotational frequency error $\Delta n$ becomes very small, such output is stabilized. An output of the rotational frequency controller 11 is input to the memory 12 from time to time.

Figure 2:
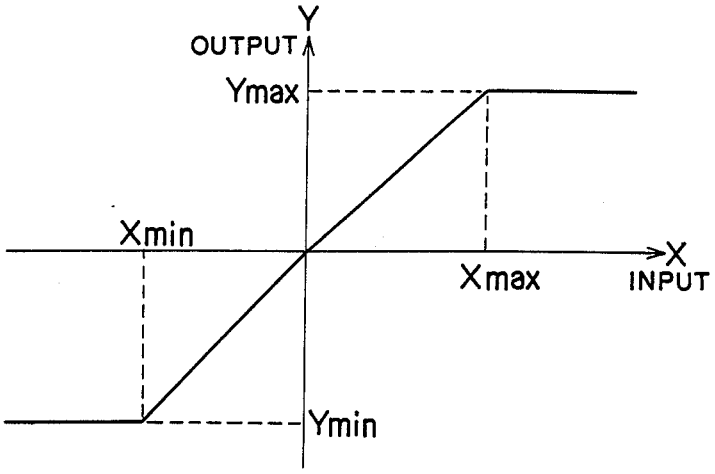
FIG. 2 is a characteristic diagram of the limiter characteristic of the rotational frequency control apparatus of the first embodiment shown in FIG. 1.

An output of the memory 12 is given to the limiter 13 from time to time. A characteristic of the limiter 13 is intended, as indicated in FIG. 2, to generate an output Y proportional to an input X and to limit an excessive output in case the input X is set in the range of $X_{min} < X < X_{max}$.

An output of the limiter 13 is used as the target intake amount $Q_T$ of the engine 1 and is sent to the error amplifier 14, to which an output $Q_e$ of the hot-wire type intake amount sensor 15 is also input. This hot-wire type intake amount sensor 15 has good response and generates an electrical output corresponding to the intake amount of the internal combustion engine 1.

The error amplifier 14 obtains an error $\Delta Q$ between such output $Q_e$ and the target intake amount $Q_T$ and outputs it to the intake controller 16. The intake controller 16 operates with such intake amount error $\Delta Q$ and provides an output.

This output becomes a duty signal in relation to the intake amount $Q_e$ outputted from the hot-wire type intake amount sensor 15 and the target intake amount $Q_T$.

An output of this intake controller 16 is generated in such a direction as to reduce the error $\Delta Q$ and therefore it is stabilized when the error $\Delta Q$ becomes minimal. An output of the intake controller 16 is input to the memory 17 from time to time. An output of this memory 17 is applied to the limiter 18 from time to time. A characteristic of the limiter 18 is same as that of the limiter 13. An output of the limiter 18 is converted to an electrical signal by the driver 6.

Such electrical signal is then sent to the solenoid valve 5 having the linear characteristic. The solenoid valve 5 is provided to obtain an intake amount adjusting loop in combination with the hot-wire type intake amount sensor 15 having good response.

The solenoid valve 5 operates to assure the opening area corresponding to an electrical signal obtained from the driver 6 and changes a valve position in proportion to an input voltage.

When the solenoid valve 5 opens in accordance with the electrical signal as explained above, the air sucked by the intake pipe 2 flows through the bypass routes **4*a*, 4*b* and thereby the intake air amount of the internal combustion engine 1** increases and decreases.

A rotational frequency of the internal combustion engine 1 is thus stabilized to the target value and the intake amount is also stabilized to the target value. The intake adjusting signal in such stabilized condition adjusts the error $\Delta Q$ to minimal value.

This is because errors conceived in each structural element for adjusting an intake amount such as fluctuation in amount of leakage air at the unloaded position of throttle valve 3, variation in characteristic due to the initial characteristic error of the solenoid valve 5 and the temperature of the engine 1, the dependency on power supply voltage of the driver 6 and the dependency on gain by air density are adjusted by the intake adjusting signal.

The limiter 18 is given an extreme limiting value corresponding to a value almost accumulating errors conceived in respective structural elements for adjusting the intake amount. Therefore, in case the hot-wire type intake amount sensor 15 fails and the feedback operation by the intake amount $Q_e$ is no longer carried out, an adjustment is limited by the limiter 13 and the divergence of the intake gas amount is prevented even if the intake adjusting signal diverges and thereby the divergence of the rotational frequency of the engine (over-running of engine or stop of operation) can be prevented.

Next, the rotational frequency adjusting signal adjusts the target intake amount $Q_T$ in such a way as to almost match a rotational frequency $n_e$ of the engine to the target rotational frequency $n_T$ by adjusting the error $\Delta n$ to minimal value. This is because fluctuation in loss in each part of the engine, the variation in thermal efficiency due to the temperature or variation of load due to various accessories such as lamps and motors are adjusted by the rotational frequency adjusting signal.

Moreover, the limiter 13 is given an adequate limiting value corresponding to a value almost accumulating errors due to the loss at respective points and the variation in load of the engine. Therefore, if the rotational frequency sensor 8 fails and the feedback of the rotational frequency is no longer carried out, the adjustment is limited by the limiter 13 even if the rotational frequency adjusting signal diverges and the target intake gas amount does not diverge. Accordingly, the divergence of rotational frequency of the engine is prevented.

When the throttle valve 3 opens and the engine is set to the loaded condition, the non-load switch 19 detects such condition and the switches 21 and 22 operate, suspending operations of the rotational frequency controller 11 and the intake controller 16.

Therefore, outputs of the rotational frequency controller 11 and the intake controller 16 stored in the memories 12 and 17, namely the adjusting signals are held at the final value under the unloaded condition and the solenoid valve 5 is controlled on the basis of such a final value.

Since the value being held corresponds to the variation of the rotational frequency due to various factors, the control condition of the solenoid valve 5 does not suddenly change to the loaded condition from the unloaded condition.

In the first embodiment of FIG. 1 explained above, the adjusting signal is generated only on the basis of the difference between the target value and actual value but it is also possible to generate the adjusting signal by combining an item which is proportional to the target value and the item based on difference between the target value and actual value.

Since it is desirable that the adjusting speed of the intake controller 16 is higher than that of the rotational frequency controller 11 in order to further enhance the effect of the present invention, it is also desirable that the proportional, integral or differential adjusting gain of the rotational frequency controller 11 is set higher than that of the intake controller 16.

Moreover, in the first embodiment, the hot-wire type intake amount sensor is used, but another type of sensor, for example, the Karman's vortex street type sensor may be used. In the same way, another type of the actuator can also be applied as the intake adjusting and control means, in place of the solenoid valve 5.

In this embodiment, the intake amount is increased or decreased by the bypass routes, but a control means of a type that directly opens or closes the throttle valve can also be applied.

As the unloaded condition detecting means, a non-load switch 19 is applied, but a similar control may also be realized by detecting the unloaded condition with various kinds of sensors such as a throttle valve opening sensor.

A pair of the switches 21 and 22 is provided respectively corresponding to the rotational frequency controller 11 and intake controller 16, but only one switching means may also be used in common.

Moreover, the memories 12 and 17 in the embodiment hold the final value of the adjusting signal under the unloaded condition and it is also possible to suppress the fluctuation of value being held by employing a system for holding an average value corresponding to an adequate time interval under the loaded condition.

In case an adjusting allowance of the rotational frequency adjustment or intake adjustment is not so large, the corresponding memory may also be eliminated.

Next, the second embodiment of the present invention is explained with reference to FIG. 3 to FIG. 6.

Figure 3:
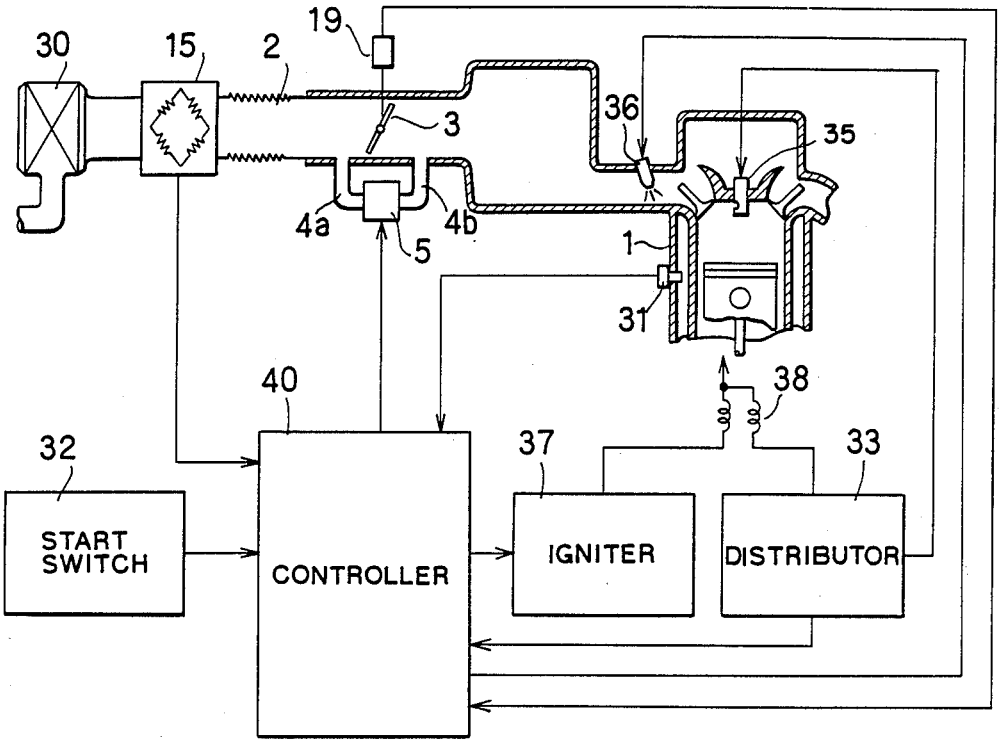
FIG. 3 is a block diagram indicating the outline of the rotational frequency control apparatus of an internal combustion engine illustrating a second embodiment of the present invention.

FIG. 3 is a rotational frequency control apparatus of an internal combustion engine in the second embodiment. The reference numeral 1 denotes an internal combustion engine, connected with an intake route 2. An air cleaner 30, an intake sensor 15 and a throttle valve 3 are provided at specified positions along this intake route 2. The bypass routes 4*a*, 4*b* of the intake route 2 are also provided before and after the throttle valve 3. The bypass routes 4*a*, 4*b* are provided with a bypass route control mechanism 5 consisting of an intake control valve (ISC valve) 51 (see FIG. 5) used as an intake control means. 19 is an idle switch as a non-load switch which detects full-close position of the throttle valve 3, 31 is a temperature sensor which detects temperature of the internal combustion engine 1, 32 is a start switch which detects the start condition of the internal combustion engine 1. 33 is a distributor comprising a crank angle sensor 34 (see FIG. 4), which distributes a high voltage to an ignition plug 35. A rotational frequency of internal combustion engine 1 can also be detected by the crank angle sensor 34. 40 is a controller which controls intake control valve 51 on the basis of an output signal from each member. The controller 40 controls fuel by driving an injector 36 and also controls power supply period and ignition timing of ignition coil 38 by controlling an ignitor 37.

Figure 4:
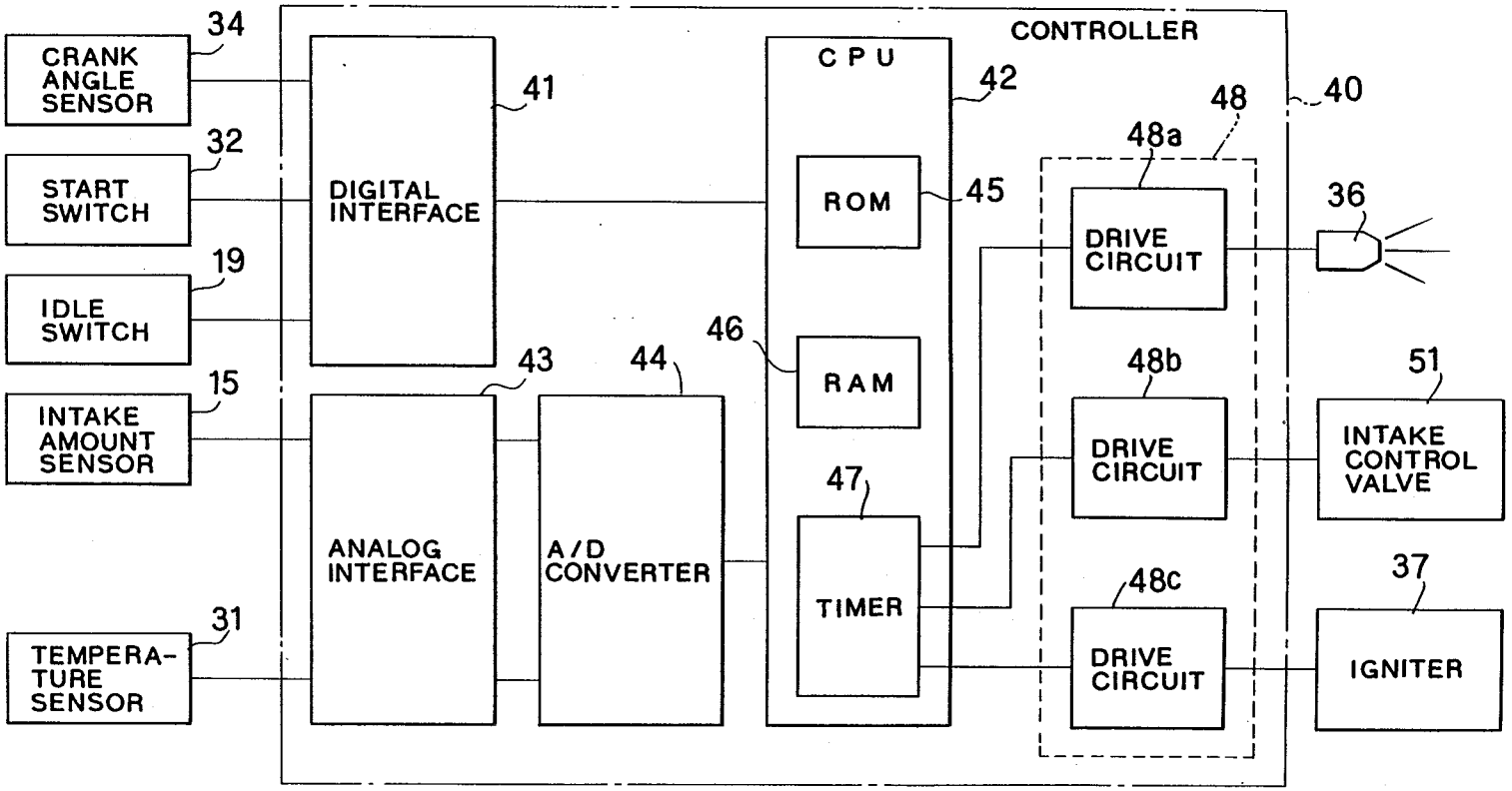
FIG. 4 is a detailed block diagram of the rotational frequency control apparatus of the second embodiment illustrated in FIG. 3.

FIG. 4 is a structure of controller 40. 41 is a digital interface which receives digital inputs from the crank angle sensor 34, start switch 32 and idle switch 19 and provides an output to a CPU 42. 43 is an analog interface which receives analog inputs from an intake amount sensor 15 and the temperature sensor 31 and applies an output to the CPU 42 through an A/D converter 44. The CPU 42 comprises a RAM 45, ROM 46 and timer 47 and controls the injector 36, intake control valve 51 and ignitor 37 through the drive circuits 48*a*–48*c* on the basis of respective inputs described above.

Figure 5:
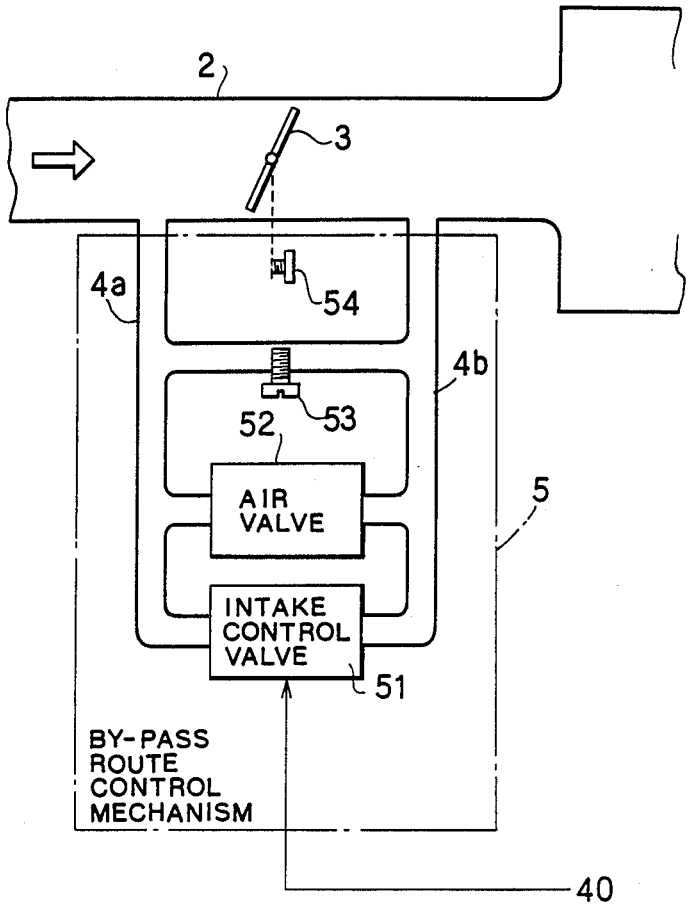
FIG. 5 is a detailed block diagram of a bypass route mechanism of the embodiment of FIG. 3.

FIG. 5 is a structure of the bypass route control mechanism 5. The intake control valve 51 is actually a linear solenoid valve which controls intake amount by changing the opening area of routes 4*a*, 4*b* through the duty control. 52 is a wax type air valve which adjusts flowing area by utilizing the characteristic that wax changes between solid and liquid depending on the temperature. 53 is an air adjusting screw to be used for adjusting air flow of the bypass routes 4*a* and 4*b*, which is used for absorbing the initial fluctuation. 54 is a throttle adjusting screw which adjusts full closing position of the throttle valve 3 and thereby determines a leakage flow rate when the throttle valve 3 is totally closed.

FIG. 6 is a dynamic block diagram of the apparatus mentioned above, particularly the CPU 42. 61 is a target intake amount generator which generates the target intake air amount $Q_0$ of the engine depending on temperature of engine and gear position of the automatic transmission gear, 62 is a generator of intake amount other than the adjusting intake amount of the intake control valve 51, namely total flow rate $Q_M$, which sums leakage flow amount of the wax type air valve 52, air adjusting screw 53 and throttle adjusting screw 54 and the leakage flow rate of the intake control valve 51, for the target intake amount of the engine. 63 is a converter which converts adjusting amount $Q_s$ by the intake control valve 51 into duty signal depending on "$Q_0$-$Q_M$" and 64 is a correcting part which corrects a voltage of the duty signal. The intake control valve 51 usually multiplies a drive voltage (battery voltage) in order to convert duty to a current since flow rate is almost proportional to current. Thus, flow rate can be controlled to almost the target intake amount with good response by driving the intake control valve 51 depending on the predetermined condition of the internal combustion engine 1. In view of executing such basic control (prospect control) with improved accuracy, the deviation between the target rotational frequency $N_0$ by a target rotational frequency generator 65 and actual rotational frequency $N_e$ of engine detected by the rotational frequency sensor 8 is input to the rotational frequency feedback controller 66 in order to generate corrected output and thereby the target intake air amount $Q_0$ is corrected. Here the target rotational frequency generator 65 generates the target rotational frequency in conjunction with an input of the target intake amount generator 61. Moreover, the rotational frequency feedback controller 66 integrals errors by sampling the inputs of rotational frequency deviation in every predetermined period and controls its output with the limiter. The errors from the prospect amount described above mainly by fluctuation of internal combustion engine 1 can be corrected by operation of the rotational frequency feedback controller 66.

Depending on deviation between the corrected target intake air amount $Q_0'$ and the intake air amount $Q_e$ of engine detected by the intake amount sensor 15, the flow rate feedback controller 67 makes control in order to bring the deviation to zero. This control is basically the same as the control by rotational frequency feedback controller 66. The intake air deviation is sampled for every predetermined period to provide error integration and an output thereof is limited by the limiter. The flow rate feedback loop usually has a loop gain of 10–100 times in comparison with the rotational frequency feedback control loop and also has good response in control. As explained above, fluctuation of flow rate characteristic and aging characteristic mainly of the intake control valve 51, fluctuation of flow rate characteristic and aging characteristic of the wax type air valve 52 are quickly corrected. As explained ealier, the rotational frequency control apparatus having good response characteristic may be obtained through combination of three principal control systems.

In above embodiment, it is desirable to use the hot-wire type sensor having good response as the intake amount sensor 15. Moreover, as the intake control valve 51, it is desirable to use a rotary solenoid valve also having good response, in addition to the linear solenoid valve having good response. In addition, as the intake amount sensor 15, the vane type or Karman type sensor may be used. As the intake control valve 51, a step motor type control valve may also be used.

As explained previously, the rotational frequency control apparatus of the internal combustion engine of the present invention provides following effects.

Firstly, since the loop for adjusting an intake amount to the target value and the loop for adjusting a rotational frequency to the target value are used in combination under the unloaded condition, the adjusting operation can be realized quickly and since a memory for holding a rotational frequency and adjusting amount of intake under the unloaded condition of the engine and the intake control means is controlled by applying a value held under the loaded condition, the sudden change of intake amount during transfer to the loaded condition from the unloaded condition can be prevented and such disadvantage as abnormal increase or decrease of the rotation frequency can be avoided.

Secondly, generation of fluctuation in rotational frequency particularly due to the secondary factor can be prevented and rotational frequency of the internal combustion engine may be stabilized even in the initial start condition of engine or after aging of filter after use for a considerable period.

Thirdly, with combinational use of the target rotational frequency control loop of the internal combustion engine and the target intake air control loop, the amount of air taken in by the engine when the throttle is perfectly closed is previously stored and such stored value is subtracted from the target intake amount. Therefore, such a subtracted air amount corresponds well to the target rotational frequency and the rotational frequency control and good response can be realized.

What is claimed is:

1. A rotational frequency control apparatus of an internal combustion engine comprising:

rotational frequency adjusting means for generating a target intake amount of the engine on the basis of a respective actual rotational frequency and a target rotational frequency of the internal combustion engine;

intake amount detecting means arranged in an intake route of said engine for sending an electrical output corresponding to an intake amount by detecting said intake amount of said engine;

intake adjusting means for outputting an intake control signal on the basis of an actual intake amount detected by said intake amount detecting means and said target intake amount outputted from said rotational frequency adjusting means;

intake drive and control means for controling an increase and decrease of said intake amount corresponding to said intake control signal sent from said intake adjusting means;

switching means for operating said rotational frequency adjusting means and said intake adjusting means so that said actual rotational frequency coincides with said target rotational frequency while said engine operates under an unloaded operating condition and switches operation modes of both adjusting means so that operations of both adjusting means stop while said engine operates under a loaded operating condition; and memory means for respectively storing said target intake amount outputted from said rotational frequency adjusting means and said intake control signal outputted from said intake adjusting means under said unloaded operating condition and for holding a final target intake amount and a final intake control signal under said loaded operating condition and also outputting the operating signal to said intake drive and control means based on said final target intake amount or said final intake control signal.

2. A rotational frequency control apparatus of an internal combustion engine according to claim 1, wherein said rotational frequency adjusting means comprises:

a target rotational frequency generator which generates the target rotational frequency of said internal combustion engine;

an error amplifier which compares said target rotational frequency output from said generator with the actual rotational frequency detected by a rotational frequency sensor provided in said engine and then outputs an error between said rotational frequencies;

a rotational frequency controller which inputs an error signal output from the error amplifier and then outputs a rotational frequency adjusting signal to eliminate said error using at least one of proportional, integral and differential operation to said memory means; and a limiter which inputs said rotational frequency adjusting signal supplied from said rotational frequency controller through said memory means and then limits at least the upper limit value of said adjusting signal to a value equal to or lower than a predetermined value and then outputs said adjusting signal to said intake adjusting means as said target intake amount.

3. A rotational frequency control apparatus of an internal combustion engine according to claim 1, wherein said intake adjusting means comprises;

an error amplifier which inputs said target intake amount output from said rotational frequency adjusting means and said electrical output corresponding to an intake amount of the engine supplied from said intake amount detecting means and outputs, by calculation, an error between said target intake amount and said actual intake amount;

an intake controller which inputs an error signal output from said error amplifier and outputs an intake adjusting signal as to eliminate said error using at least one of proportional, integral and differential operation to said memory means; and a limiter which inputs said intake adjusting signal supplied from said intake controller through said memory means and limits at least the upper limit value of said adjusting signal to a value equal to or lower than a predetermined value and then outputs a drive signal as said final intake control signal to said intake control means.

4. A rotational frequency control apparatus of an internal combustion engine according to claim 1, wherein said switching means comprises;

a first switch which is provided to the throttle valve and switches operation modes of said rotational frequency adjusting means to a drive or stop mode with an output of a non-load switch which detects an unloaded condition of the engine; and a second switch which switches operation modes of said intake adjusting means to the drive or stop mode with an output of said non-load switch.

5. A rotational frequency control apparatus of an internal combustion engine according to claim 1, wherein said memory means comprises;

a first memory which inputs a rotational frequency adjusting signal as an output of a rotational frequency controller forming said rotational frequency adjusting means when the engine is operated under the unloaded condition to sequentially store said rotational frequency adjusting signal and outputs said a rotational frequency adjusting signal to a first limiter forming said rotational frequency adjusting means and also outputs the final rotational frequency adjusting signal under the unloaded operating condition being stored when the engine transfers to the loaded operating condition to said first limiter, and a second memory which inputs an intake adjusting signal as an output of an intake controller forming the intake adjusting means under said unloaded operating condition to sequentially store said intake adjusting signal and outputs said intake adjusting signal to a second limiter forming the intake adjusting means and also outputs the final intake adjusting signal under said unloaded operating condition being stored when the engine transfers to the loaded operating condition to said second limiter.

6. A rotational frequency control apparatus of an internal combustion engine according to claim 1, wherein said intake drive and control means comprises;

an intake control valve provided to a bypass route which is provided to said intake route for bypassing a throttle valve provided in the intake route of the engine and a driver which controls opening or closing said intake control valve with said intake control signal which is adjusted on the basis of the rotational frquency of the engine and said intake amount.

7. A rotational frequency control apparatus of an internal combustion engine comprising an intake amount detecting means which detects an intake amount of the internal combustion engine, a rotational frequency detecting means which detects a rotational frequency of said engine, a target intake amount setting means which sets a target intake amount of said engine, a target rotational frequency setting means which sets a target rotational frequency of said engine, a rotational frequency adjusting means which adjusts a rotational frequency to drive said engine in accordance with deviation between said target rotational frequency and detected rotational frequency, an intake amount adjusting means which adjusts intake amount to be supplied to said engine in accordance with a deviation between said target intake amount and detected intake amount, and an intake control means which respectively controls adjusting operations of both said adjusting means in accordance with said respective deviations, wherein a memory means is provided to previously store the intake amount to be sucked to said engine when a throttle valve provided to an intake pipe of the engine is fully closed, in addition to the intake amount adjusted by said intake amount adjusting means, and said intake control means supplies air to said engine in an amount equal to the target intake amount subtracted by the intake amount stored in said memory means.

8. A rotational frequency control apparatus of an internal combustion engine according to claim 7, wherein;

said intake pipe is provided with a bypass route to bypass said throttle valve and said bypass route opens so that an intake control valve provided to said bypass route can supply a sufficient amount of air to said engine with a control signal sent from said intake control means.

9. A rotational frequency control apparatus of an internal combustion engine according to claim 7, wherein;

said intake amount stored in said memory means is previously set to correct said target intake amount with increase of engine temperature.

10. A rotational frequency control apparatus of an internal combustion engine according to claim 7, wherein said rotational frequency adjusting means, intake amount adjusting means and memory means are formed by a central processing unit (CPU);

said rotational frequency adjusting means in said CPU is formed by a target rotational frequency generator which generates said target rotational frequency and a rotational frequency feedback controller which controls feedback rotational frequency by calculating deviation between a detected rotational frequency of said rotational frequency detecting means and the target rotational frequency outputted from said target rotational frequency generator; and said intake amount adjusting means is formed by a target intake amount generator, a total flow rate generator which generates a total flow rate summing the leakage flow rates of various intake amount adjusting valves provided to the bypass routes bypassing the throttle valve of said engine, a flow rate feedback controller which controls feedback of flow rate of the intake amount by calculating deviation between said target intake amount and intake amount detected by said intake amount detecting means, a converter which converts, to a duty signal, the adjusted intake amount adding deviation between outputs of said target intake amount and said total flow rate generator and control output of said flow rate feedback controller, and a voltage corrector which corrects voltage of the duty signal output from said converter.

11. A rotational frequency control apparatus of an internal combustion engine according to claim 7, wherein said intake amount previously stored to said memory means is set in a flow rate summing leakage intake amounts at an intake control valve, air valve and air adjusting screw respectively provided to each branch route of bypass routes provided in parallel to said intake route bypassing said throttle valve.

12. A rotational frequency control apparatus of an internal combustion engine according to claim 7, wherein said memory means and both adjusting means are formed by central processing unit (CPU), and said CPU controls a rotatinal frequency of said engine with a rotational frequency feedback control loop which controls a detected rotational frequency of said rotational frequency detecting means as a control element and intake amount feedback control loop which controls a detected intake amount of said intake amount detecting means as a control element.

* * * * *

UNITED STATES PATENT AND TRADEMARK OFFICE

CERTIFICATE OF CORRECTION

PATENT NO. : 4,856,475

DATED : August 15, 1989

INVENTOR(S) : SETSUSHIRO SHIMOMURA ET AL.

It is certified that error appears in the above-identified patent and that said Letters Patent is hereby corrected as shown below:

Col. 1, line 34, after "in" insert --the official gazette of the--;
Col. 1, line 35, "162340 1984," should be --162340/1984,--;
Col. 1, line 43, after "described" insert --in the--; same line, after "above" insert --official gazette,--;
Col. 1, line 56, before "above" insert --in the gazette explained--.

Col. 8, line 60, "ealier" should be --earlier--.
Col. 9, line 30, "taken in" should be --intaken--;
Col. 11, line 39, "frquency" should be --frequency--.

Col. 12, line 60, "rotatinal" should be --rotational--;
Col. 12, line 64, after "and" insert --an--.

Signed and Sealed this

Twenty-seventh Day of November, 1990

*Attest:*

HARRY F. MANBECK, JR.

*Attesting Officer*

*Commissioner of Patents and Trademarks*